United States Patent [19]

Sondy

[11] 3,990,074

[45] Nov. 2, 1976

[54] KILN ALARM ACTIVATED BY KILN SHUTOFF

[76] Inventor: Dominic P. Sondy, 1609 Mills Ave., North Muskegon, Mich. 49445

[22] Filed: Nov. 14, 1975

[21] Appl. No.: 631,957

[52] U.S. Cl. ..... 340/417; 200/61.45 R; 219/506; 236/94; 337/411; 337/402; 340/227.1; 432/32

[51] Int. Cl.[2] ..... G08B 19/00

[58] Field of Search ..... 432/120, 32, 124; 431/15; 236/94; 165/11; 340/417, 222, 272, 227.1, 230; 337/402–405, 411, 299, 300; 200/61.45 R, 61.48–61.50, 61.52; 219/506

[56] References Cited

UNITED STATES PATENTS

| | | | |
|---|---|---|---|
| 2,675,600 | 4/1954 | Dawson | 236/15 |
| 3,178,539 | 4/1965 | Crawford et al. | 236/94 |
| 3,287,530 | 11/1966 | Dawson | 337/402 |

*Primary Examiner*—John W. Caldwell
*Assistant Examiner*—Donnie L. Crosland
*Attorney, Agent, or Firm*—Price, Heneveld, Huizenga & Cooper

[57] ABSTRACT

An apparatus activates an alarm for a kiln operator when the heat and temperature provided by a kiln reach a predetermined level thereby activating a kiln shut-off weight and switch. The kiln shut-off weight rotates to engage a rod coupled to a switching means for activating an alarm.

12 Claims, 5 Drawing Figures

KILN ALARM ACTIVATED BY KILN SHUTOFF

BACKGROUND OF THE INVENTION

1. Field of the invention.

This invention relates to mechanisms for automatically interrupting the electrical heating circuit of a kiln; and, specifically, to an alarm device for signaling when such interruption has taken place.

2. Description of the prior art.

Kilns are used by ceramic artists and hobbyists for the firing of ceramic products. Various automatic control systems for turning off the kilns are known. A mechanism for automatically interrupting the electrical heating circuit of a kiln after the interior of the kiln has been exposed to a predetermined amount of heating is disclosed in U.S. Pat. Nos. 2,675,600 and 3,287,530 issued to W. P. Dawson. The mechanism disclosed employs a mechanical system of rods, levers, switches, and a heat sensitive element for initiating the movement of the various elements comprising the system when heating is finished. In particular, one of the elements is a pivoted weight which rotates downward when an upper portion of the weight is released by a lever. The downward rotation of the weight actuates a switch which turns off the electrical supply to the kiln. Turning off the electrical supply shuts off the heat source to the kiln.

However, the kiln operator may make many unnecessary trips to visually check to determine whether he kiln has shut off. Knowing whether a kiln has shut off is important to prevent the possibility of inadvertant overfiring due to an equipment malfunction and as a tool for choosing proper firing time. If the length of the firing is known, the fired product can be examined to see if in the future a shorter or longer firing time is desired. Additionally, the kiln operator may not be aware that the cooldown period has started and thus prolong the cooldown period longer than necessary. During such unnecessary extension of the cooldown period, the kiln, and the investment in the kiln, is not being utilized. Firings of ceramic products which could take place do not take place.

SUMMARY OF THE INVENTION

This invention teaches making a kiln operator aware that a firing has been completed and there has been an automatic shut-off of the kiln. Since the kiln operator is aware of the status of the kiln, he can make the best use of his time and of the availability of the kiln. An apparatus in accordance with an embodiment of this invention is advantageous because it can be readily attached for operation to a kiln having an automatic shut-off system. In effect, the existing automatic shut-off system is used to trigger a signaling device to alert the kiln operator.

The apparatus in accordance with an embodiment of this invention includes a switch activated by the rotation of a shut-off weight included in an automatic kiln shut-off system and causing the activation of a signaling mechanism. The preferred embodiment of the invention includes a bent actuator rod which is pivotally mounted so one end supports a switch activating weight and the other end is in the path of the rotating shut-off weight. When the rotating shut-off weight moves the bent actuator arm, the switch activating weight is released engages an aligned contact switch so as to close it. The contact switch completes a circuit to activate a signaling mechanism.

The apparatus in particularly advantageous because it does not require any switching means to withstand the heat present on the wall of the kiln. The switching means can be spaced from the wall of the kiln. Reducing the requirements for withstanding heat on the switching means permits less expensive construction. The activation of the switching means also has an advantageously reduced cost because the shut-off mechanism is used to provide those members used for actuation which must withstand heat. As a result, an alarm system fabricated in accordance with an embodiment of this invention is relatively inexpensive to fabricate and relatively simple to assemble and to install.

BRIEF DECRIPTION OF THE DRAWINGS

DETAILED DESCRIPTION OF THE PREFERRED EMBODIMENT

Figure 5:
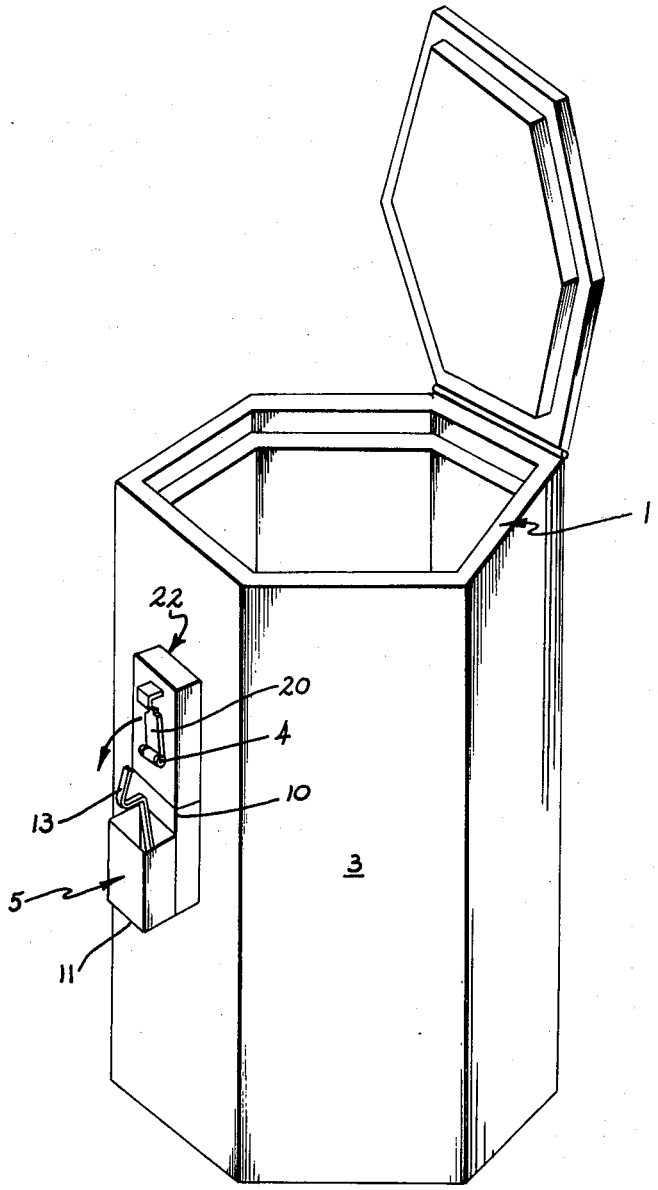
FIG. 5 is a front perspective view of a kiln with a swinging weight shut-off mechanism and an alarm mechanism in accordance with an embodiment of this invention.

Referring to FIG. 5, as is known in the prior art a kiln 1 has a heat source shut-off mechanism 22, with a swinging weight 20, mounted to a side wall 3 of kiln 1. Swinging weight 20 rotates downward about a pivot point 4 when shut-off of the kiln heat source, for example electrical heating coils, takes place. A detailed description of a kiln having an automatic shut-off mechanism is contained in U.S. Pat. No. 2,675,600 issued to W. P. Dawson on Apr. 20, 1954, the disclosure of which is incorporated by reference herein. Mounted on kiln 1 and below shut-off mechanism 2 is an alarm mechanism 5 having a bent actuator rod 13 aligned to be engaged by weight 20 as it swings downward. Typically, alarm mechanism 5 is mounted to a side projection 10 extending laterally outward from side wall 3. Thus, since swinging weight 20 is typically spaced from side wall 3 by part of shut-off mechanism 2, spacing alarm mechanism 5 from side wall 3 facilitates aligning bent actuator rod 13 so it is engaged by swinging weight 20.

Referring additionally to FIGS. 1–4, a support housing 11 extends from side projection 10 of a kiln having an automatic shut-off mechanism. Bent actuator rod 13 is pivotally mounted on support housing 11 at a pivot point 14. The height and lateral location of one end of actuator rod 13 is such that it is in the path of swinging weight 20 when swinging weight 20 rotates toward projection 10 of the kiln. A switch 18 is aligned with respect to a movable actuator weight 17 so vertical displacement of weight 17 can engage switch 18 and close it. Actuator weight 17 is held in a position above switch 18 by engaging a portion of actuator rod 13 with an engaging means 19 in weight 17. Removing actuator rod 13 from supporting actuator weight 17 permits actuator weight 17 to move downward.

Advantageously, actuator rod 13 is spring biased into a supporting position by a spring 51. Typically, spring 51 is mounted on housing 11 and applies a force to actuator rod 13 to keep rod 13 in a position to support actuating weight 17. Of course, the force applied by spring 51 is not so great that actuator rod 13 remains in place after it has been engaged by swinging weight 20. The purpose of spring 51 is to prevent accidental jarring of actuator rod 13 and to facilitate the initial set-up of actuating weight 17 for a firing. That is, spring 51 can be made strong enough to position actuator rod 13 into a supporting position when actuator weight 17 is moved up into a position spaced from switch 18. Actuator weight 17 can have a stop 52 extending outward and capable of engaging housing 11 to prevent excessive upward travel of actuator weight 17 after actuator rod 13 is in a position to support actuator weight 17. Switch 18 is electrically connected through a conductor 30 and a conductor 31 to a signaling device 32.

Signaling device 32 can include a switch 33 which is connected in series with switch 18 to provide a master on/off for signaling device 32. Without switch 33 signaling device 32 would be signaling whenever actuating weight 17 was not supported by actuating rod 13 thereby closing switch 18. Signaling device 32 can further include a series combination of a voltage source 50, such as a battery, and an alarm 21, such as a bell, connected in series with switch 33.

Figure 1:
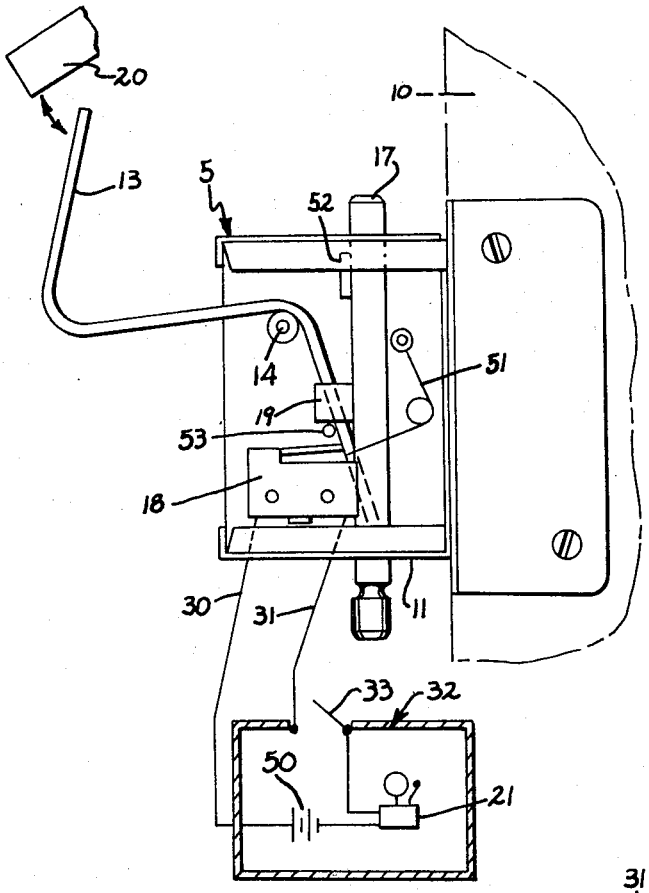
FIG. 1 is a side elevation interior view of an alarm mechanism in accordance with an embodiment of this invention.
Figure 2:
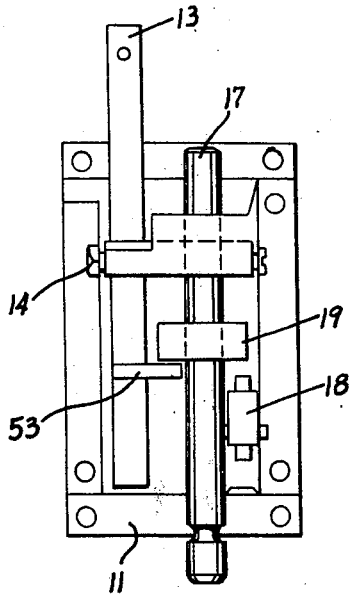
FIG. 2 is a front elevation interior view of an alarm mechanism in accordance with an embodiment of this invention.
Figure 3:
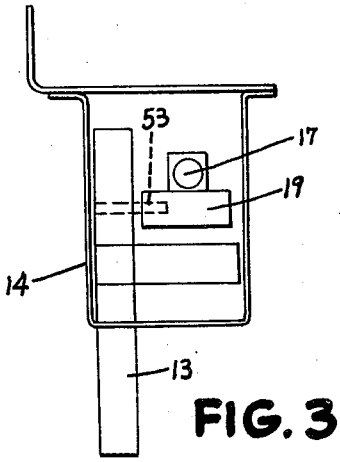
FIG. 3 is a plan interior view of an alarm mechanism in accordance with an embodiment of this invention.

FIGS. 1, 2 and 3 show interior views of a preferred embodiment of this invention. Switch 18 is advantageously a micro-switch with a relatively low activating force and aligned to engage actuator weight 17 when weight 17 moves downward. Engaging means 19 is a protrusion extending from actuator weight 17, typically elongated, and is aligned to engage a protrusion 53 forming a part of actuator rod 13 which can be positioned to support actuator weight 17 so switch 18 is not closed. One end of rod 13 is aligned so swinging weight 20 can remove rod 13 as a support for actuator weight 17. Swinging weight 20 typically produces a fixed force on actuator rod 13. To make sure that this force is sufficient to disengage actuator rod 13 as a support from actuator weight 17, the distance from pivot point 14 to where swinging weight 20 engages actuator rod 13 is advantageously made greater than the distance from pivot point 14 to where actuator weight 17 is supported by actuator rod 13. In effect, the moment arm to the force produced by swinging weight 20 is chosen to be greater than the moment arm to actuator weight 17. Thus the force at weight 17 is greater than the force at weight 20.

Figure 4:
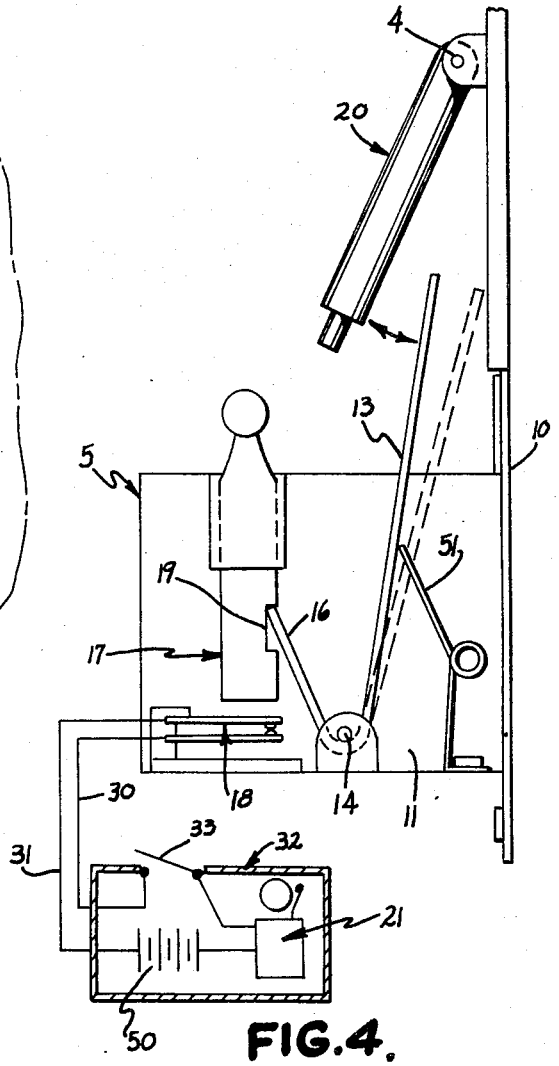
FIG. 4 is a side elevation interior view of another embodiment of this invention.

FIG. 4 shows a side interior view of another embodiment of this invention. Engaging means 19 is a notch in weight 17 which can move downward and close switch 18.

OPERATION

To install an apparatus in accordance with an embodiment of this invention housing 11 is attached to a kiln having a shut-off mechanism with a swinging weight. The length and location of the swinging weight are important when locating housing 11 with its associated bent actuating rod 13. Typically, kiln 1 has a side projection 10, extending outward from kiln side wall 3, to which housing 11 can be attached by screws. Of course, if there is no side projection 10, housing 11 can be sufficiently elongated so housing 11 can be directly screwed to side wall 3 and still have bent actuator rod 13 sufficiently spaced from side wall 3 so rod 13 is aligned to be engaged by swinging weight 20.

To prepare an apparatus in accordance with an embodiment of this invention for operation, actuator weight 17 is raised above switch 18 and supported by actuator rod 13. System switch 33 is closed so alarm 21 will activate when activating switch 18 is closed. As is known in connection with shut-off mechanisms such as those described in the above cited Dawson patents, swinging weight 20 is latched in an "up" position by a lever which is supported at an end inside the kiln by a pyrometric cone. A ceramic product to be fired is placed inside the kiln and the heating source of the kiln is turned on. Advantageously, the pyrometric cone is chosen so it deforms when the ceramic product is properly fired.

As is further known in connection with shut-off mechanisms such as those described in the above cited Dawson patents, when a predetermined amount of heat has been introduced into the kiln, the pyrometric cone deforms and releases the lever which, in turn, releases swinging weight 20 causing it to rotate about a mounting to an outside wall of the kiln. Rotation of shut-off swinging weight 20 causes the top of actuator rod 13 to move to an offset position toward projection 10. Movement of actuator rod 13 removes support from actuator weight 17 and causes weight 17 to move vertically downward and contact switch 18. Weight 17 exerts a sufficient force that switch 18 is closed and an electrical connection is completed. Since switch 33 has been closed to activate signaling device 32, an alarm 21 will be activated. Advantageously, electrical conductors 30 and 31 to signaling device 32 are long enough to permit convenient location of signaling device 32. For example, signaling device 32 can be located in the room where the kiln operator is located while the kiln is firing a ceramic product in another room. It ca be appreciated that operation of an apparatus in accordance with an embodiment of the invention having a relatively simple construction and few components can be very reliable. Further, construction of the alarm system can be relatively inexpensive.

Various modifications and variations will no doubt occur to those skilled in the various arts to which this invention pertains. For example, the coupling between the actuator rod and the actuating weight can vary from that disclosed herein. The bell indicator can be replaced by a light indicator, an audio-visual combination indicator or a telephone which can be dialed to relay a coded signal to any location desired by the operator. These and all other variations which basically rely on the teachings through which this disclosure has advanced the art are properly considered within the scope of this invention.

The embodiments of the invention in which an exclusive property or privilege is claimed are defined as follows:

1. In combination with a kiln and a kiln shut-off mechanism with a rotating shut-off weight, an alarm system mounted to the kiln including:

a bent actuator rod pivotally mounted so a first portion of the actuator rod is in the path of the rotating weight;

a vertically movable actuator weight mounted to engage and be supported by a second portion of the bent actuator rod when the actuator weight is displaced from its lowermost position;

an activating switch located in the vertical path of travel of the actuator weight and spaced from the wall of the kiln for completing an electrical connection; and a signaling device connected in series with the activating switch for signaling the shut-off of the kiln.

2. An alarm system as recited in claim 1 further comprising:

a housing mounted on the side of the kiln and partially enclosing the actuator rod, the actuator weight and the activating switch.

3. An alarm system as recited in claim 2 further comprising:

a system switch connected in series with the activating switch and the signaling device.

4. An alarm system as recited in claim 3 wherein the signaling device includes:

a power source; and a bell electrically connected in series to the power source.

5. An alarm system as recited in claim 4 wherein the activating switch is a micro-switch.

6. An alarm system as recited in claim 5 further comprising:

a spring mounted on the housing for applying a force to the actuator rod to keep the rod in a position to support the actuator weight.

7. An alarm system as recited in claim 6 wherein the portion of the actuator rod for engaging the rotating weight is a greater distance from the pivotal mounting of the actuator rod than the portion of the actuator rod for engaging the actuator weight.

8. An alarm system as recited in claim 7 further comprising a stop protrusion extending from the actuator weight for engaging the housing and limiting upward movement of the actuator weight after the actuator rod is in a position to support the actuator weight.

9. In combination with a kiln and a kiln shut-off mechanism with a rotating weight, an alarm system including:

a housing mounted to the side of the kiln;

a bent actuator rod pivotally mounted on the housing so a portion of the actuator rod is in the path of the rotating weight;

an elongated actuator weight restricted to movement in a vertical direction and aligned to engage a portion of the actuator rod for supporting the actuator weight above the lowermost position of the actuator weight;

an activating switch mounted to the housing, spaced from the wall of the kiln and located in the vertical path of travel of the actuator weight so downward displacement of the actuator weight can close the activating switch;

a system switch connected in series with the activating switch;

a power source connected in series with the activating and system switches;

a signaling device connected in series with the power source, the activating switch and the system switch; and a spring mounted on the housing for applying a force to the actuator rod to keep the rod in a position to support the actuator weight.

10. An alarm system as recited in claim 9 wherein the portion of the actuator rod for engaging the rotating shut-off weight is a greater distance from the pivotal mounting of the actuator rod than the portion of the actuator rod for engaging the actuator weight.

11. An alarm system as recited in claim 10 further comprising a stop protrusion extending from the actuator weight for engaging the housing and limiting upward movement of the actuator weight after the actuator rod is in a position to support the actuator weight.

12. An alarm system as recited in claim 11 wherein the activating switch is a micro-switch.

* * * * *